United States Patent [19]

De Baan et al.

[11] Patent Number: 4,838,823

[45] Date of Patent: Jun. 13, 1989

[54] DEVICE FOR MOORING A FLOATING BODY, FOR EXAMPLE A SHIP, TO A BODY ANCHORED TO THE SEABED, FOR EXAMPLE A MOORING TOWER

[75] Inventors: Jacob De Baan, Maassluis; Marinus Uittenbogaard, Kamerik, both of Netherlands

[73] Assignee: Bluewater Terminal Systems N.V., Curacao, Netherlands Antilles

[21] Appl. No.: 131,353

[22] Filed: Dec. 10, 1987

[30] Foreign Application Priority Data

Dec. 19, 1986 [NL] Netherlands ..... 8603241

[51] Int. Cl.[4] ..... B63B 21/52

[52] U.S. Cl. ..... 441/3; 114/230

[58] Field of Search ..... 114/230; 441/3-5; 141/387

[56] References Cited

U.S. PATENT DOCUMENTS

| | | | |
|---|---|---|---|
| 4,226,204 | 10/1980 | Tuson | 441/3 |
| 4,351,260 | 9/1982 | Tuson et al. | 114/230 |
| 4,567,842 | 2/1986 | Gibb et al. | 114/230 |
| 4,611,550 | 9/1986 | Di Tella et al. | 114/230 |

*Primary Examiner*—Joseph F. Peters, Jr.
*Assistant Examiner*—Jesûs D. Sotelo
*Attorney, Agent, or Firm*—Birch, Stewart, Kolasch & Birch

[57] ABSTRACT

A device for mooring a vessel to a mooring tower, buoy, seabed, or the like, has a device for absorbing excessive mooring forces. The vessel will normally travel a given distance when attached to the mooring tower or the like, due to forces such as waves, wind, or tide. However, when extreme conditions are encountered such that the vessel attempts to travel beyond this given distance, the device for absorbing can accommodate these excessive forces. The device for absorbing will permit the vessel to travel a distance which is greater than or equal to the given distance under these extreme conditions.

9 Claims, 9 Drawing Sheets

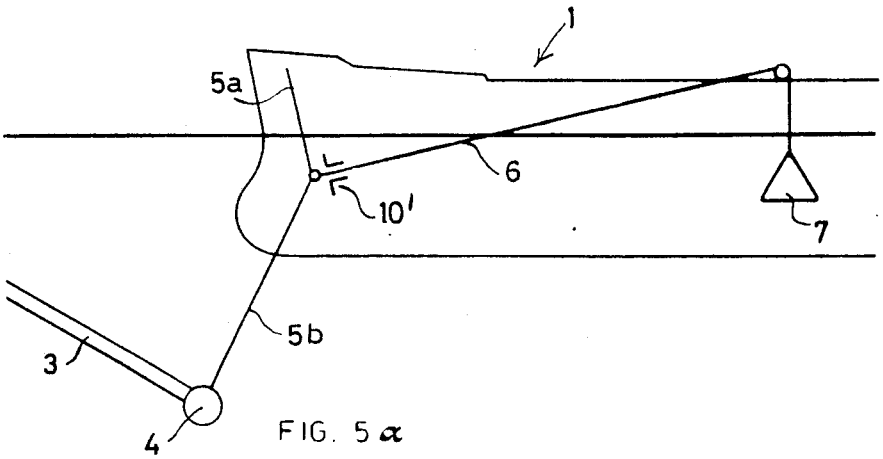
FIG. 5 α

DEVICE FOR MOORING A FLOATING BODY, FOR EXAMPLE A SHIP, TO A BODY ANCHORED TO THE SEABED, FOR EXAMPLE A MOORING TOWER

BACKGROUND OF THE INVENTION

Our invention relates to a device for mooring a floating body, such as a ship, comprising a device anchored to the seabed, such as a mooring tower or a mooring buoy, or a second floating body, at least one rigid arm, at least one weight connected by means of a tension member to the floating body or the device anchored to the seabed, and an additional means of force.

DESCRIPTION OF THE PRIOR ART

Such a device is known from, inter alia, French Pat. No. 2,420,475 (EMH).

Devices of the above-mentioned type are generally used for mooring tanker vessels at sea to offshore terminals. These offshore terminals can consist of, for example, a mooring tower or a mooring buoy, on which there can be means for loading or unloading the tanker with oil.

In areas where very strong winds, currents and high waves can occur, the mooring device must be capable of absorbing as gradually as possible the movements of the tanker vessel away from and towards the mooring device. For this, the device as a whole must have considerable elasticity. Attempts in this direction have consisted of using very heavy anchor chains, weights on the anchor chains, the use of rigid arms with a weight on the end, etc.

SUMMARY OF THE INVENTION

The object of our invention is to produce such a device with improved elasticity.

To that end, the invention provides a device of the above-mentioned type, in which so long as a particular mooring force is not exceeded, the distance which the floating body travels relative to the device anchored to the seabed or the second floating body in a direction away from the said device or the said second body is shorter than or equal to the distance which the floating body would cover if no additional means of force were present, while if the particular mooring force is exceeded, the floating body can travel a distance in the above-mentioned direction which is greater than or equal to the distance which it could travel if no additional means of force were present.

The effect of the measure according to our invention can be compared with connecting various springs in series, with the proviso that not all "springs" are "stretched" at the same time, but that initially the first "spring" is "stretched", after which the next "spring" is "stretched". In normal circumstances of waves, wind and tide, no such great mooring force will occur that the additional means of force is activated: but if in exceptional circumstances such forces are exerted on the vessel, a new dynamic equilibrium arises within the field of action of the additional means of force because the vessel is capable of travelling a greater distance.

In other words, until a certain mooring force is reached, the vessel is held relatively close to the mooring system through the action of the first "spring", but if the vessel is driven a greater distance from the mooring device through the action of, for example, an accumulation of higher waves (wave group), then such displacement can be produced without great forces in the system through the use of an additional "spring".

Depending on the embodiment chosen, the invention can be used either on a mooring buoy or on a tower. Preferably, the tension member comprises at least two separate components and the force to be exerted by the additional means of force acts upon the connection between two components.

Preferably, the tension member comprises at least two separated components and the force to be exerted by the additional means of force acts upon the connection between two components.

In a preferred embodiment, the additional means of force comprises a weight which is connected in a suitable manner to the connection of the two components of the tension member.

In another preferred embodiment, the tension member comprises at least three components and several additional means of force engage with at least two connections between two individual components.

In a further preferred embodiment, the device is constructed on either side of the floating body or the device anchored on the seabed.

In yet another preferred embodiment, the additional means of force is attached near the end of a first rigid arm, the other end of said first rigid arm being fixed to an end of a second rigid arm the other end of which is fixed to the connection of the two components of the tension member, both arms pivoting together around a pivot point fixed to the floating body or the device anchored to the sea bed, the position at rest of the additional means of force being determined by a stop against which one of the arms comes to rest.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 5*a* shows an embodiment of the invention in which the tension member is resting against a stop;

DESCRIPTION OF THE PREFERRED EMBODIMENTS

Figure 1:
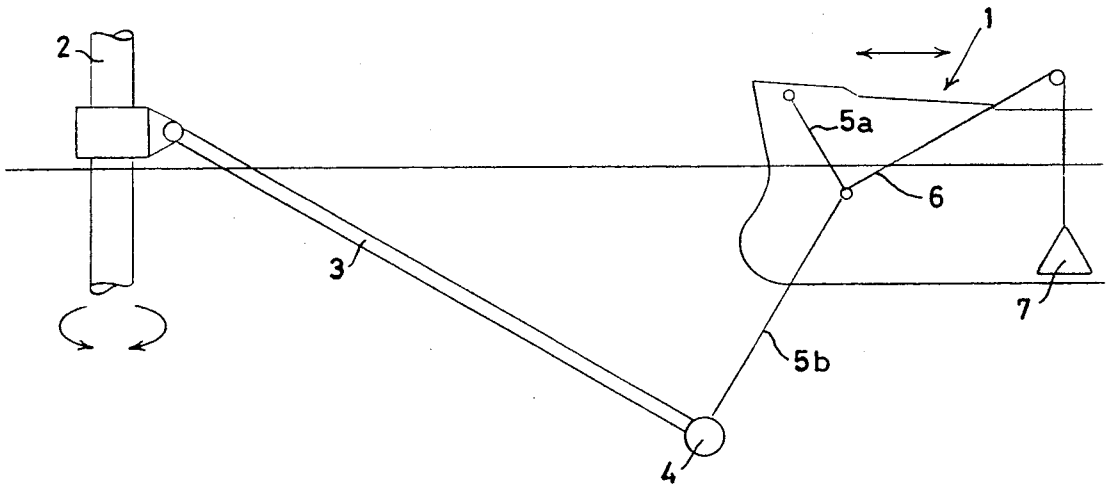
FIG. 1 shows an embodiment of the invention in which the additional means of force is a weight.

In FIG. 1, a vessel 1 is moored to a mooring tower or mooring buoy 2. The mooring device comprises a rigid arm 3, at the end of which there is a weight 4. The weight 4 is connected to the vessel 1 by means of a tension member, comprising two components 5*a* and 5*b*. The tension member is connected by means of a cable 6 to the additional means of force, in this example a weight 7. In the figure, the weight 7 is at rest and is lying on the flat of the bottom of the vessel. When no forces are exerted through wind, current or waves, the weight is not lifted from the flat of the bottom. The distance which the vessel can cover is determined by the elasticity of the system comprising the rigid arm 3, the weight 4 and the component 5*b* of the tension member.

Figure 2:
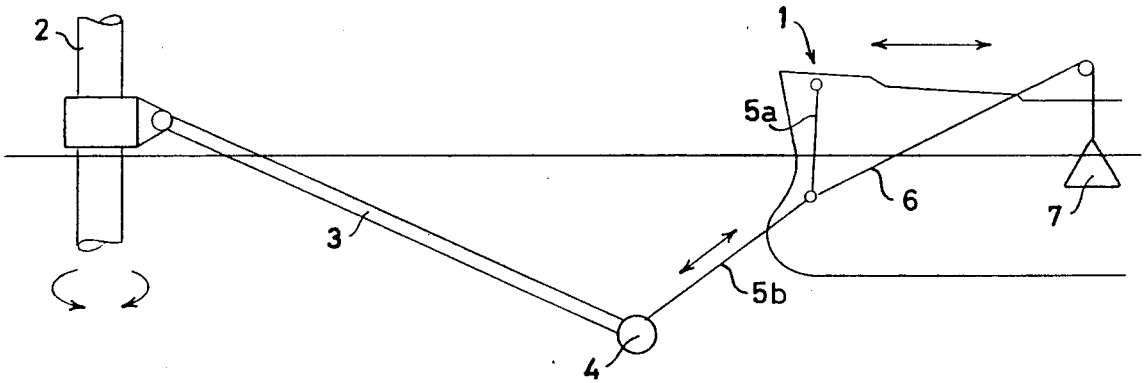
FIG. 2 shows the embodiment according to FIG. 1, in which the mooring force is so great that the weight exerts forces on the system.

In FIG. 2, such forces are exerted on the vessel that the elasticity of the system comprising the rigid arm 3, the weight 4 and the component 5*b* is insufficient to allow the vessel to carry out the movement which it "wants" to make. The mooring force is now greater than the weight force of the weight 7, which is now lifted from the flat of the bottom of the vessel. Added to the elasticity of the system comprising the rigid arm 3, the weight 4 and the component 5*b* we now have the elasticity of the system comprising the component 5*a*, the cable 6 and the weight 7. The distance which the vessel can cover is now greater.

Figure 3:
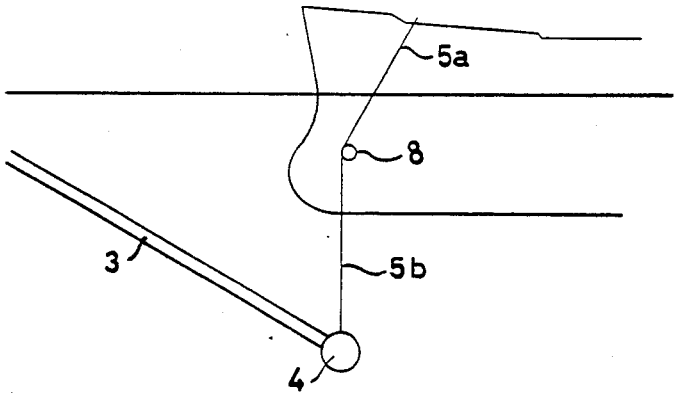
FIG. 3 shows a mooring device according to the invention in which the tension member comprises a cable or chain resting against a stop fastened to the vessel.

In FIG. 3 the tension member comprises a cable resting against a stop fastened to the vessel. So long as the mooring force is not too great, the distance which the vessel can cover depends on the elasticity of the system comprising the rigid arm 3, the weight 4 and the part 5*b* of the cable which is beneath the stop. If the vessel wants to move further away from the mooring tower or the mooring buoy, the cable comes away from the stop, and the distance to be travelled by the vessel is determined by the elasticity of the system comprising the rigid arm 3, the weight 4, the two components 5*a* and 5*b*, and the vessel itself.

Figure 4:
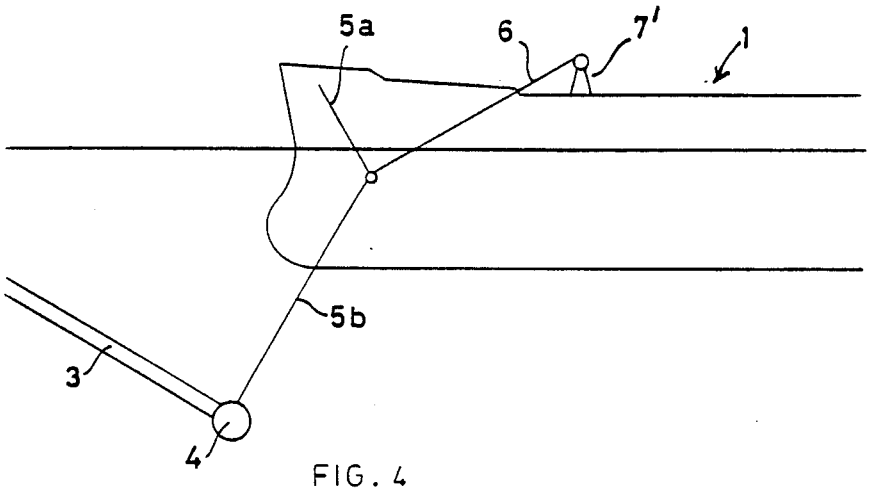
FIG. 4 shows a mooring device according to the invention in which the additional means of force is an automatic winch.

In FIG. 4, the additional means of force is an automatic winch 7'. The additional means of force can also be a hydraulic piston cylinder device, or an elastic pulling component or the like.

Figure 5:
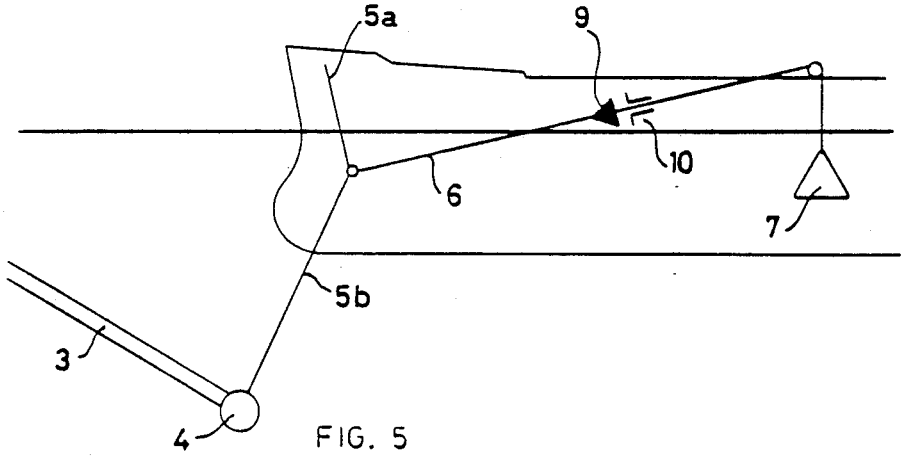
FIG. 5 shows a mooring device according to the invention in which the additional means of force is a weight, and disposed on the cable is a stopping or blocking element which rests on a stop fastened to the vessel.

In FIG. 5, the additional means of force is a weight which at rest hangs free. The position of the weight at rest is determined by a stop component 9 disposed on the cable 6 and abutting a stop 10. Said stop can be, for example, a guide eye or a hawse pipe in the vessel.

In FIG. 5*a*, the weight also hangs free, but the height at which the weight hangs is determined by the fact that the tension member—the components 5*a* and 5*b*—rests against a stop 10', possibly a guide eye or hawse pipe here too.

Figure 6:
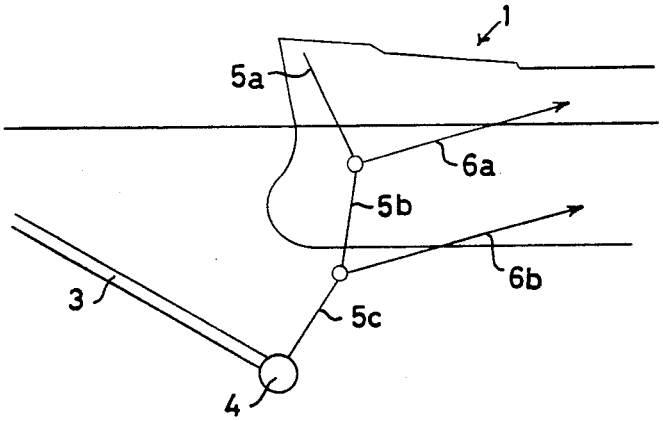
FIG. 6 shows an embodiment in which two cables run from the tension member each to a means of force.

In FIG. 6, the tension member is divided into three components 5*a*, 5*b* and 5*c*. Running from the connections between two successive components are cables 6*a*, 6*b*, each to additional means of force (not shown). The effect of this is of three successively coupled "springs", so that the movements of the vessel are absorbed even more gradually.

Figure 7:
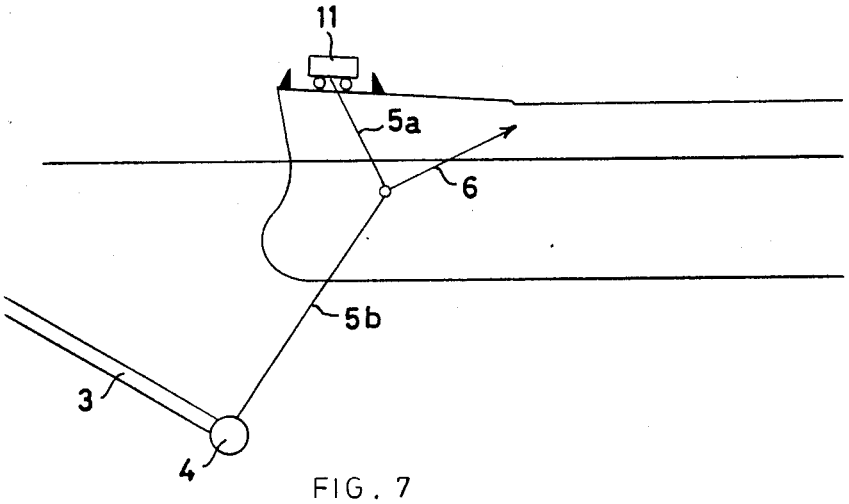
FIG. 7 shows an embodiment in which the connection of the tension member to the vessel is made horizontally displaceable.

FIG. 7 shows an embodiment in which the fastening of the component 5*a* to the vessel is made horizontally displaceable by means of a device 11 suitable for the purpose.

Figure 8:
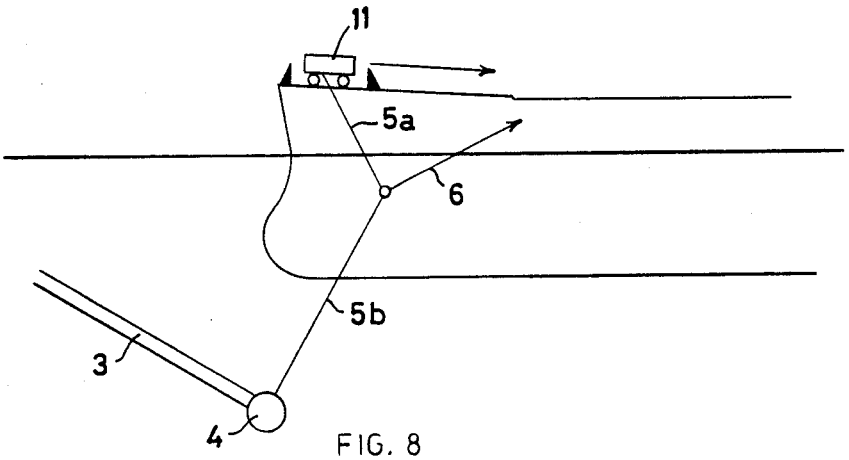
FIG. 8 shows a mooring device according to FIG. 7, but in which a force is exerted in the horizontal direction on the connection between the tension member and the vessel.

FIG. 8 shows an arrangement which corresponds to that of FIG. 7, the difference being that a force can be exerted on the fastening 11 in the horizontal direction by a second additional means of force. The effect of this is comparable with that of the embodiment according to FIG. 6.

Figure 9:
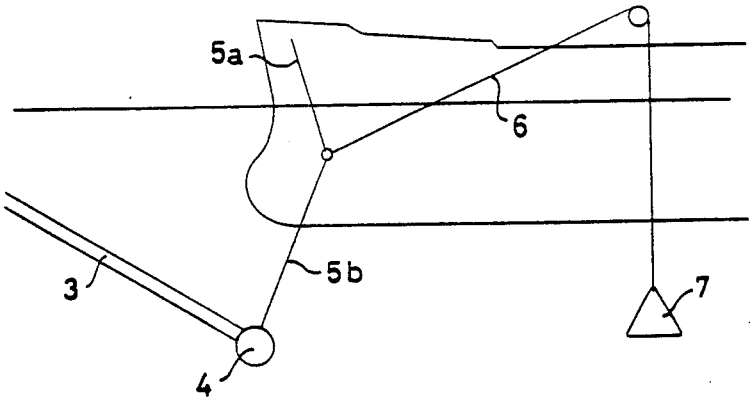
FIG. 9 shows an embodiment in which the additional means of force is a weight hanging outside the vessel.

In FIG. 9, the additional means of force is a weight 7 which hangs outside the ship.

Figure 10:
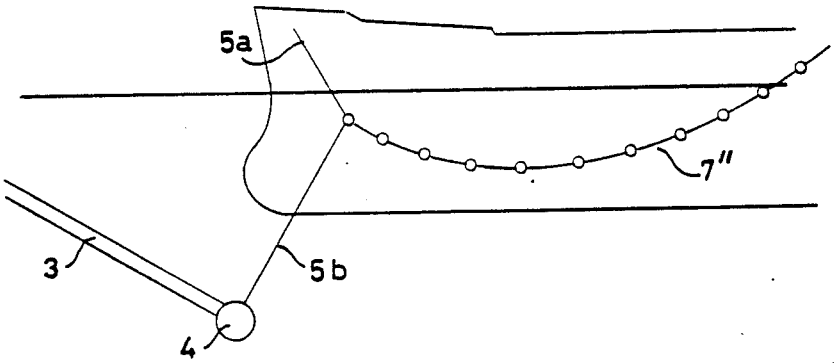
FIG. 10 shows an embodiment in which the additional means of force is a length of chain hanging outside the vessel.

In FIG. 10, the additional means of force is a length of chain 7. Said chain is fastened directly to the tension member 5*a*–5*b* and thus at the same time replaces the cable 6.

Figure 11:
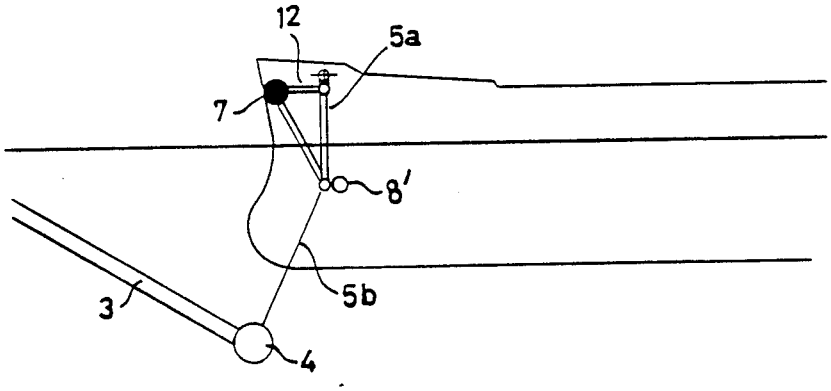
FIG. 11 shows an embodiment in which the first component of the tension member is rigid, and in which the additional means of force is fixed to a transversely projecting arm which is in turn fixed to the first component of the tension member.

In FIG. 11, the first component 5*a* of the tension member is rigid and lies with its bottom end against a stop 8'. The additional means of force is a weight 7 at the end of an arm 12, which is in turn fastened to the component 5*a* near its top end.

Figure 12:
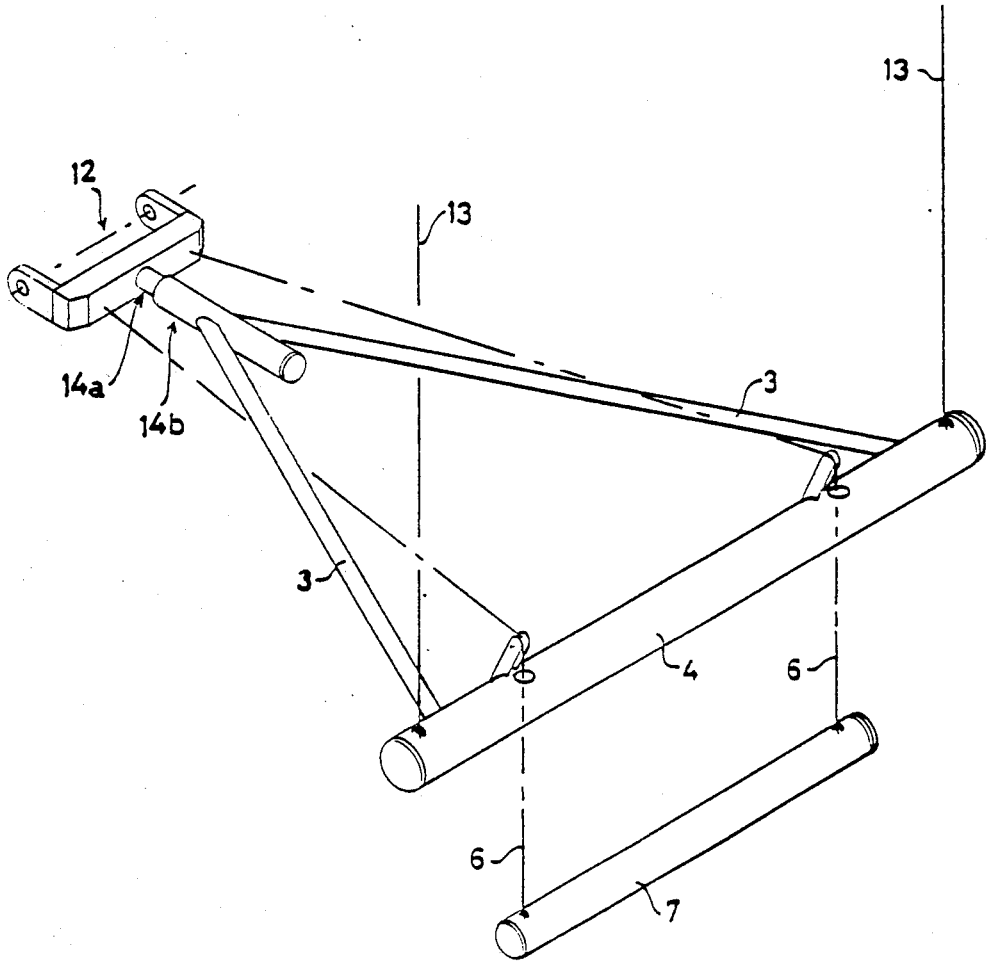
FIG. 12 shows an embodiment in which the first and second component are fastened to each other in such a way that they can slide out, and in which the additional means of force is a weight which is connected to the vessel or the mooring tower or mooring buoy by means of cables which are led over the weight fixed to the end of the rigid arm.

FIG. 12 shows a mooring device of the "wishbone" type. This device is connected at 12 to the mooring tower, and the weight 4 is connected to the vessel by means of cables 13. The fastening of the rigid arm 3 to the mooring tower or mooring buoy is made slidable at 14*a* and 14*b*. The additional means of force comprises a weight 7 which is connected by means of cables 6 to the mooring tower or mooring buoy. So long as a particular mooring force is not exceeded, the parts 14*a* and 14*b* are slid into each other; but if such forces are exerted on the vessel that the vessel wants to move a greater distance than the device at rest permits, the parts 14*a* and 14*b* slide out of each other, and the weight 7 is lifted. The vessel can now cover a greater distance, which is limited by the lengths of the parts 14*a* and 14*b* and of the cables 6.

Figure 13:
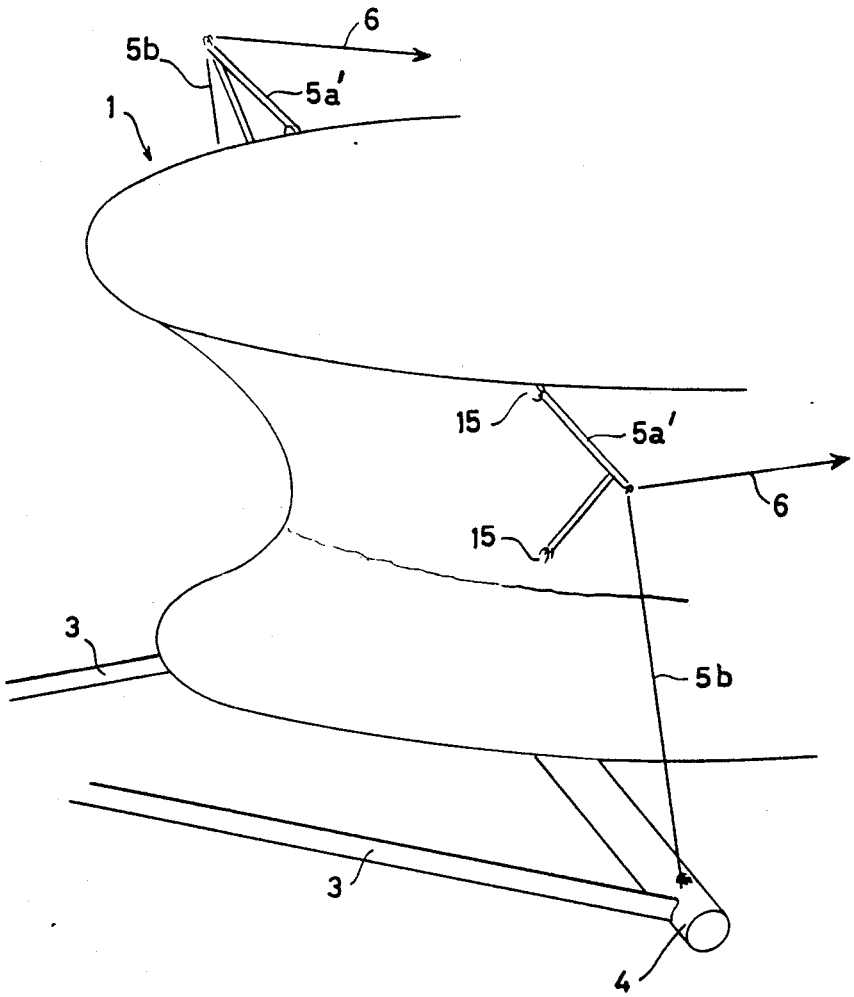
FIG. 13 shows an embodiment in which the component of the tension element fixed to the vessel is formed by a boom fixed to the outside of the vessel.

In FIG. 13, the components of the tension element which are connected to the ship consist of rigid booms 5*a'* which can rotate about a vertical axis at 15.

Figure 14:
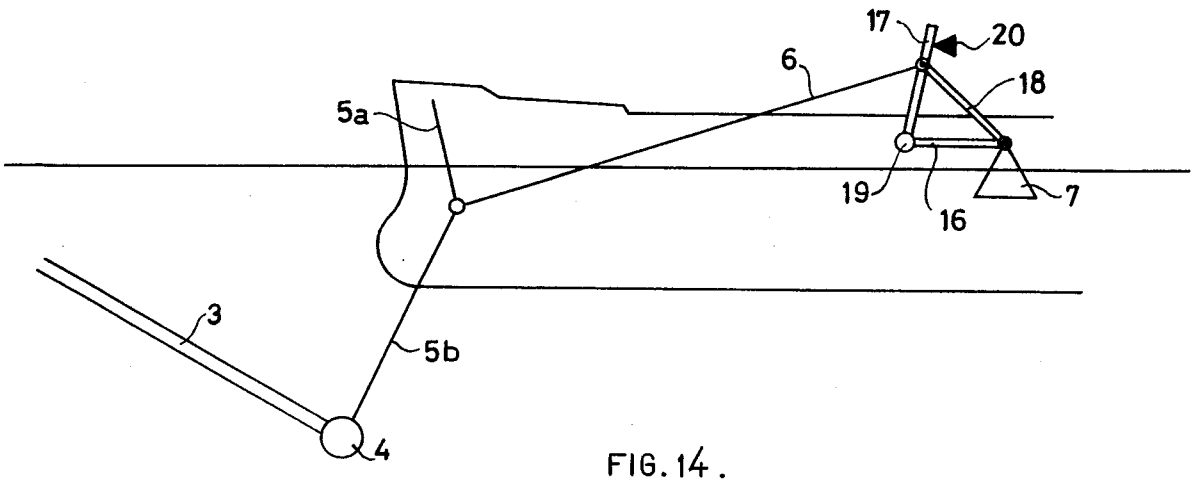
FIG. 14 shows an embodiment in which the additional means of force is attached near the end of a first rigid arm, the other end of which is fixed to a second rigid arm, both rigid arms pivoting together around a common pivot point fixed to the vessel.

In FIG. 14, the weight 7 is attached near the end of a first rigid arm 16, the other end of which is fixed to the lower end of a second rigid arm 17. The upper end of the second rigid arm 17 is connected to the connection of the two components 5*a*, 5*b* of the tension member. A strut 18 takes up the tension caused by the weight 7. Both rigid arms 16,17 pivot together at 19 around a pivot point fixed to the vessel. The position at rest of the rigid arms 16,17 and the weight 7 is determined by the stop 20 against which the rigid arm 17 comes to rest.

It goes without saying that the invention is not restricted to the embodiments shown here. In particular, it is possible within the scope of protection of the claims in all cases for the additional means of force to be fastened to the device anchored to the seabed, instead of to the floating body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mooring device for a floating body comprising:

a device anchored to the seabed, said device having at least one rigid arm pivotally connected thereto;

first weight means connected to said arm for exerting a force thereon;

tension means for connecting said arm to said floating body, said tension means having at least two components joined at a connection, the first component being attached to the floating body and the second component being attached to said first weight means;

second weight means attached to said tension means at the connection between said at least two components for exerting a force on said tension means, said floating body having a normal mooring force exerted thereon whereby said floating body will travel a first distance determined by the force of the first weight means and if said normal mooring force is exceeded, the floating body will travel a second distance determined by the combined forces of said first and second weight means, said second distance being greater than the first distance.

2. The mooring device as recited in claim 1, wherein said floating body is a ship and said device anchored to the seabed is one of a mooring tower, a mooring buoy and a ship at anchor.

3. The mooring device as recited in claim 1, wherein the second weight means comprises a weight attached to the connection of the tension means by one of a cable and a chain.

4. The mooring device as recited in claim 1, wherein said second weight means comprises the floating body itself, said tension member rests against a stop provided at the level of the connection of the at least two components when the floating body fails to travel beyond said first distance.

5. The mooring device as recited in claim 1, wherein said second weight means comprises a hydraulic piston-cylinder device attached to the connection of the tension means by one of a cable and a chain.

6. The mooring device as recited in claim 1, wherein said second weight means comprises an automatic winch attached to the connection of the tension means by one of a cable and a chain.

7. The mooring device as recited in claim 1, wherein said second weight means comprises an elastic pulling component attached to the connection of the tension means by one of a cable and a chain.

8. The mooring device as recited in claim 1, wherein said second weight means is located inside the floating body at the end of one of a cable and a chain, said second weight means having a rest positioned determined by a stop against which the tension means comes to rest.

9. The mooring device as recited in claim 1, wherein said tension means has at least one more additional component, said additional component being joined to said tension means at a second connection whereby said tension means has at least three components and two connections, said mooring device further comprising additional weight means for exerting a force on said tension means, said additional weight means being attached to said tension means at the second connection.

* * * * *